United States Patent [19]

Holmstrand

[11] Patent Number: 4,784,295

[45] Date of Patent: Nov. 15, 1988

[54] SLURRY DISPENSING SYSTEM HAVING SELF-PURGING CAPABILITIES

[75] Inventor: Allan L. Holmstrand, Bloomington, Minn.

[73] Assignee: Magnetic Peripherals Inc., Minneapolis, Minn.

[21] Appl. No.: 188,150

[22] Filed: Apr. 27, 1988

Related U.S. Application Data

[63] Continuation of Ser. No. 15,774, Feb. 17, 1987, abandoned.

[51] Int. Cl.[4] ..... B65D 88/54

[52] U.S. Cl. ..... 222/148; 222/318; 222/424; 239/119; 239/126; 51/263

[58] Field of Search ..... 222/148, 318, 424; 239/119, 124–127; 137/207, 207.5; 51/263, 317, 321, 292, 424, 437

[56] References Cited

U.S. PATENT DOCUMENTS

| | | | |
|---|---|---|---|
| 3,019,522 | 2/1962 | Bluth | 51/283 X |
| 4,242,841 | 1/1981 | Ushakov | 51/263 |
| 4,513,894 | 4/1985 | Doyle | 222/644 |
| 4,678,119 | 7/1987 | Doyle | 239/124 X |

*Primary Examiner*—Joseph J. Rolla
*Assistant Examiner*—Stephen B. Parker
*Attorney, Agent, or Firm*—R. M. Angus; J. A. Genovese

[57] ABSTRACT

An enclosed slurry dispensing system employs a sealed pressurized reservoir for supplying slurry through a bypass chamber to a dispensing nozzle. Excess slurry is bypassed through the bypass chamber to an intermediate chamber. Slurry is allowed to return to the reservoir through a normally-closed check valve, closed by the higher pressure of the reservoir. The system is purged by opening the reservoir to the atmosphere, creating a sub-atmospheric pressure in the bypass chamber. Air is admitted through the nozzle to purge the nozzle of slurry. At the same time, the check valve opens and excess slurry returns to the reservoir from the intermediate chamber.

4 Claims, 1 Drawing Sheet

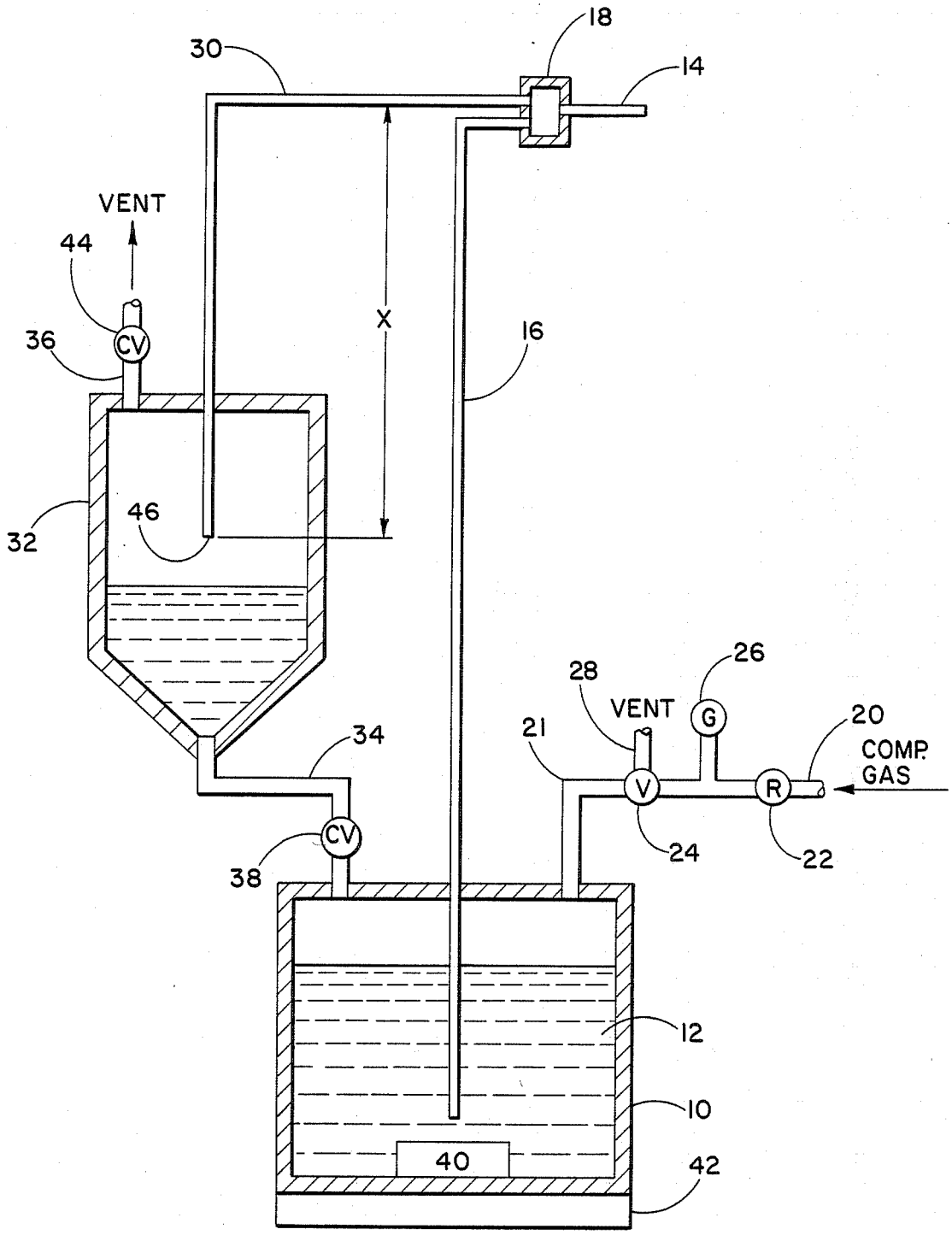
18
30
14
VENT
44
36
CV
X
16
32
46
28
26
VENT
G
21
20
COMP.
GAS
34
V
R
CV
24
22
38
12
10
40
42

SLURRY DISPENSING SYSTEM HAVING SELF-PURGING CAPABILITIES

This is a continuation of co-pending application Ser. No. 15,774 filed on Feb. 17, 1987 now abandoned.

This invention relates to polishing or lapping, and particularly to a slurry supply system or dispenser for use in conjunction with a polishing or lapping apparatus.

It is common in polishing or lapping machines to apply an abrasive slurry to the workpiece, which abrasive slurry is used in the polishing, lapping, or finishing process. Most slurry supply and dispensing systems employ a mechanism, such as a needle or nozzle for dispensing the slurry onto the workpiece. Slurry is pumped to the needle or nozzle from a reservoir, and control mechanisms control the pressure and flow of slurry. In some cases, a recovery apparatus may be employed to recover, clean and return slurry to the supply reservoir, but in most cases used slurry is simply discarded.

One problem with prior slurry supply and dispensing apparatus has been that it has not been altogether possible to clean and purge the discharge orifice of the nozzle or needle. When metering minute quantities of slurry, for example a few drops a minute, the small discharge orifice of the nozzle or needle tended to clog. In the past, clogged nozzles or needles were simply removed and discarded, but this necessitated frequent shutdowns of the lapping or polishing machine to remove and replace clogged needles. The clogged condition of the nozzle or needle caused a cessation in the delivery of slurry to the workpiece. If the machine was not promptly shut down for replacement of the needle, damage often occurred to the workpiece and to the lapping machine itself, necessitating costly repairs.

It is, therefore, an object of the present invention to provide a slurry supply and dispensing system wherein the discharge orifice of the nozzle or needle may be periodically cleaned without shutdown of the lapping or polishing machine.

Another object of the present invention is to provide a slurry supply and dispensing system wherein pressurized gas applied to the supply reservoir transports the slurry to the nozzle or orifice, and removal of the pressurized gas from the supply reservoir reduces the pressure at the nozzle to back-flush the nozzle to clear it of material.

Another object of the present invention is to provide a slurry supply and dispensing system wherein slurry is transported under pressure through a bypass chamber to an intermediate recovery chamber with the discharge nozzle being connected to the bypass chamber to meter small amounts of slurry to the workpiece, the arrangement being such that upon removal of the pressure to transport the slurry, the slurry backflushes to draw air through the nozzle to clear it of material.

In accordance with the present invention, a supply and dispensing system provides slurry to a nozzle or needle. A bypass chamber bypasses excess slurry to an intermediate recovery chamber. The reservoir is maintained under pressure to transport the slurry. Periodically the reservoir may be opened to the atmosphere to reverse the pressure within the bypass chamber to flush slurry from the nozzle, thereby purging the slurry from the nozzle and return slurry from the intermediate chamber to the main reservoir.

One feature of the present invention resides in the fact that the purging and cleaning of the slurry dispensing system requires only a few seconds, as opposed to several minutes required to replace clogged nozzles, so that cleaning may be accomplished during ordinary manufacturing processes.

Another feature of the present invention resides in the fact that nozzles can be cleaned more often than in prior systems, lessening the likelihood that a nozzle will clog to cease delivery of slurry. As a result, shutdowns are less frequent and costly repairs are less likely.

The above and other features of this invention will be more fully understood from the following detailed description and the accompanying drawings, in which:

The sole FIGURE is a diagram of a slurry supply and dispensing system in accordance with the presently preferred embodiment of the present invention.

Referring to the drawing there is illustrated a reservoir 10 containing a slurry 12 to be applied through needle or nozzle 14 to a workpiece (not shown). A supply conduit 16 supplies slurry to bypass chamber 18 which in turn supplies slurry to the nozzle or needle 14. Slurry in conduit 16 is ordinarily under pressure, the preferred mechanism being that reservoir 10 is an enclosed reservoir pressurized by compressed gas introduced to the conduit 20, regulator 22, and 3-way valve 24. Preferably, a gauge 26 is employed to measure the pressure in conduit 20. Valve 24 is a 3-way valve providing communication between conduit 21 connected to the interior of reservoir 10 and either conduit 20 or to the atmosphere via conduit 28.

Excess slurry not dispensed through nozzle or needle 14 is bypassed through chamber 18 through conduit 30 to intermediate chamber 32 The lower end of chamber 32 feeds by gravity through conduit 34 and check valve 38 to reservoir 10. Preferably, reservoir 10 includes a magnet 40 and magnetic actuator 42 to agitate the slurry, maintaining the abrasive material uniformly suspended in the liquid carrier or lubricant. Reservoir 10 is preferably at a lower elevational position than intermediate chamber 32, which in turn is at a lower elevational position than bypass chamber 18 and needle 14.

Preferably, intermediate chamber 32 is open to the atmosphere through conduit 36. Optionally, a check valve 44 may be placed in conduit 36 to open only when the pressure in chamber 32 exceeds atmospheric pressure. Typically, nozzle or needle 14 is interchangeable for different applications.

In operation of the slurry supply and dispensing system in accordance with the present invention, gas or air under pressure is admitted through conduit 20 and valve 24 to pressurize the enclosed chamber of reservoir 10 to a suitable pressure, such as 2 to 8 psig. Slurry is forced upwardly through conduit 16 to bypass chamber 18 and out nozzle or needle 14 to the workpiece. The pressure in bypass chamber 18, created by the backpressure within conduit 30, causes a small amount of slurry to flow through the discharge orifice of needle or nozzle 14. With relatively small conduits 16 and 30, a relatively high volume of slurry can pass through bypass chamber 18 from conduit 16 to conduit 30 for small amounts of slurry metered through nozzle or needle 14. For example, several milliliters of slurry can pass from conduit 16 to conduit 30 for each drop of slurry metered through nozzle or needle 14 Thus, slurry transport velocities may be high to maintain the abrasive in suspension and yield a uniform discharge mixture. Excess slurry is bypassed through chamber 18 and conduit 30 to intermediate chamber 32, which is at a lower elevation than bypass chamber 18. Check valve 38 prevents slurry in chamber 32 from returning to reservoir 10 through conduit 34 due to check valve 38 being closed by the pressure within the chamber 10.

When it is desired to purge the system, valve 24 is moved to a second position to vent the interior of reservoir 10 through conduits 21 and 28 to the atmosphere. This reduces the pressure within chamber 10, removing the pressure from the slurry in conduit 16. The column of slurry in conduit 30 between the upper outlet in bypass chamber 18 and the lower outlet 46, designated by dimension X in the drawing, supports a reduced, sub-atmospheric, pressure within bypass chamber 18 as the slurry in conduit 16 drains by gravity to reservoir 10. As a result, air is drawn through nozzle or needle 14 into bypass chamber 18 to thereby clean the nozzle and purge it of slurry and any foreign material. Also, some of the slurry in conduit will be drawn into bypass chamber 18, due to the reduced pressure therein. Hence, the flow of slurry in the system is reversed, and the pressure in bypass chamber is reduced to a slight vacuum for cleaning and purging purposes. At the same time, check valve 38 is opened due to the weight of the slurry in chamber 32 and the presence of atmospheric pressure in reservoir 10, permitting the slurry in intermediate chamber 32 to return to the reservoir 10. It is preferred that conduits 16 and 30 be small, for example, one-eighth inch O.D., to support a capillary column of slurry to create the desired vacuum during cleaning cycles. Conduits 34, 36, 20, 21 and 28 should be large, for example, one-quarter inch O.D., to permit quick ventilation and pressure changes and rapid draining of slurry from chamber 32 to reservoir 10.

In practice, the dispensing nozzle or needle 14 should be at the highest gravitational elevation of the system thereby aiding in the backflow or flushing of the system. Also, it is advantageous that supply conduit 16 be connected below bypass conduit 30 to bypass chamber 18 to aid in supporting the desired flows and pressures.

In practice, the cleaning or purging of the system requires only a few seconds and can be accomplished without interrupting the lapping or polishing operation. The purging can be set to be automatically accomplished at regular intervals, such as each minute or two, by an electronic timer operating valve 24.

Optionally, vent conduit 36 which vents intermediate chamber 32 to the atmosphere could include a check valve 44 which closes as the slurry in chamber 32 drains into reservoir 10. The inclusion of check valve 44 would offer the additional advantage that all air employed to purge the system must be admitted through nozzle 14, thereby assuring full cleaning of the nozzle. However, due to the very small opening of the nozzle orifice, a considerably longer time would be required to drain slurry from chamber 32 to reservoir 10. In practice, it has been found more advantageous to omit valve 44 and constantly vent chamber 32 to the atmosphere and to operate a purge cycle for a few seconds each minute or two. The purging cycle can be accomplished without interrupting the lapping or polishing operation, and the slurry in conduit 30 provides an adequate vacuum to purge the nozzle orifice.

This invention is not to be limited by the embodiment shown in the drawings and described in the description, which is given by way of example and not of limitation, but only in accordance with the scope of the appended claims.

What is claimed is:

1. A slurry dispensing system for supplying a slurry to a workpiece comprising: sealed reservoir means for containing a supply of slurry; first conduit means leading from said reservoir means and in fluid communication with said supply of slurry; selectively operable pressure means operable to force slurry from said reservoir means into said first conduit means, said pressure means comprising a gaseous pressure source in fluid communication with said reservoir means, and first valve means selectively connecting said reservoir means to said gaseous pressure source or to the atmosphere surrounding said reservoir; nozzle means for supplying slurry to a workpiece; bypass means connecting said first conduit means to said nozzle means to supply slurry under pressure from said first conduit means to said nozzle means, said bypass means diverting excess slurry; second conduit means connected to said bypass means for receiving said excess slurry from said first conduit means; chamber means at an elevation below said bypass means connected to said second conduit means to receive said excess slurry; delivery means for delivering slurry in said chamber means to said reservoir means, said delivery means including pressure-responsive, normally-closed check valve means for permitting flow of slurry through said delivery means when the pressure in said reservoir means is not greater than in said chamber means, said system being operable so that when slurry is forced from said reservoir means to said nozzle means, excess slurry is collected in said chamber means, and when said pressure means is operated to not force slurry from said reservoir means said check valve means opens to permit slurry in said chamber means to return to the reservoir means and slurry in said second conduit means forms a column of slurry which supports a sub-atmospheric pressure within said bypass means so that air is admitted through said nozzle means to clean the system.

2. Apparatus according to claim 1 wherein said chamber means is a sealed chamber, said apparatus further including check valve means venting said chamber means to the atmosphere when the pressure within said chamber means exceeds atmospheric pressure.

3. Apparatus according to claim 2 wherein said nozzle means is disposed at an elevation higher than said reservoir means.

4. Apparatus according to claim 1 wherein said nozzle means is disposed at an elevation higher than said reservoir means.

* * * * *